US011120740B2

(12) United States Patent
Kang

(10) Patent No.: US 11,120,740 B2
(45) Date of Patent: Sep. 14, 2021

(54) DISPLAY DEVICE AND METHOD OF OPERATING THE SAME

(71) Applicant: Samsung Display Co., Ltd., Yongin-si (KR)

(72) Inventor: Mi Kyung Kang, Ulsan (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 17/033,495

(22) Filed: Sep. 25, 2020

(65) Prior Publication Data

US 2021/0158752 A1 May 27, 2021

(30) Foreign Application Priority Data

Nov. 26, 2019 (KR) ..... 10-2019-0153764

(51) Int. Cl.
*G09G 3/3233* (2016.01)
*G09G 3/3291* (2016.01)

(52) U.S. Cl.
CPC ..... *G09G 3/3233* (2013.01); *G09G 3/3291* (2013.01); *G09G 2310/08* (2013.01); *G09G 2320/0252* (2013.01); *G09G 2320/0626* (2013.01); *G09G 2330/02* (2013.01)

(58) Field of Classification Search
None
See application file for complete search history.

(56) References Cited

U.S. PATENT DOCUMENTS

| | | | | |
|---|---|---|---|---|
| 8,269,702 | B2 * | 9/2012 | Kim | G09G 3/3233 345/77 |
| 10,854,135 | B2 * | 12/2020 | An | H02H 1/0007 |
| 2002/0101395 | A1 * | 8/2002 | Inukai | G09G 3/3258 345/83 |
| 2008/0024526 | A1 * | 1/2008 | Ko | G09G 3/3233 345/690 |
| 2009/0201281 | A1 * | 8/2009 | Routley | G09G 3/3233 345/212 |

FOREIGN PATENT DOCUMENTS

| | | | |
|---|---|---|---|
| KR | 2000-0010923 | A | 2/2000 |
| KR | 10-0639005 | B1 | 10/2006 |
| KR | 10-2014-0143593 | A | 12/2014 |
| KR | 10-2016-0059035 | A | 5/2016 |
| KR | 10-2017-0017035 | A | 2/2017 |

* cited by examiner

*Primary Examiner* — Dorothy Harris
(74) *Attorney, Agent, or Firm* — Lewis Roca Rothgerber Christie LLP

(57) ABSTRACT

A display device includes: a display panel including a plurality of pixels; a power manager to provide a first power supply voltage to the display panel through a first power supply line, and a second power supply voltage to the display panel through a second power supply line, and to measure a first current flowing through the first power supply line and a second current flowing through the second power supply line; and a panel driver to provide a panel driving voltage to the display panel, and to control the panel driving voltage according to a current difference between the first current and the second current.

20 Claims, 9 Drawing Sheets

FIG. 9

VGL_TB

| LI(mA) | 0 | 2.83 | 14.1 | 16.31 | 18.92 | 20 |
|---|---|---|---|---|---|---|
| VGL(V) | -10 | -10.4 | -10.9 | -11.4 | -11.9 | -12.4 |

FIG. 10

VGH_TB

| LI(mA) | 0 | 7.08 | 4.43 | 5.96 | 2.31 |
|---|---|---|---|---|---|
| VGH(V) | 6 | 5.5 | 5 | 4.5 | 4 |

FIG. 11

VINT_TB

| LI(mA) | 0 | 8 | 15 | 20 | 25 | 30 |
|---|---|---|---|---|---|---|
| VINT(V) | -5 | -4.5 | -4 | -3.5 | -2 | -1.5 |

DISPLAY DEVICE AND METHOD OF OPERATING THE SAME

CROSS-REFERENCE TO RELATED APPLICATION(S)

This application claims priority to and the benefit of Korean Patent Application No. 10-2019-0153764, filed on Nov. 26, 2019 in the Korean Intellectual Property Office (KIPO), the entire content of which is incorporated by reference herein.

BACKGROUND

1. Field

Aspects of example embodiments relate generally to a display device and a method of operating the same.

2. Description of the Related Art

In general, a display device includes a display panel for displaying an image, and a panel driver for driving the display panel. The display panel may receive a data voltage from the panel driver, may generate a driving current corresponding to the data voltage, and may display the image with a luminance corresponding to the data voltage based on the driving current. When the image to be displayed on the display panel changes from a black image to a white image, the panel driver may change (e.g., may increase) the data voltage provided to the display panel, and the display panel may generate the driving current corresponding to the changed data voltage. However, due to a leakage current generated inside the display panel, a certain time may be required for the display panel to generate the driving current corresponding to the changed data voltage. Accordingly, there may be a problem in which the display panel displays the image with a luminance lower than the luminance corresponding to the changed data voltage during the certain time. In other words, to display the image with a desired luminance, it may be desirable to improve a response speed of the display panel.

To improve the response speed of the display panel, a comparative operating method calculates a driving current during the certain time, and increases the data voltage accordingly. However, the comparable operating method does not take into account driving conditions of the display device (e.g., a temperature change of the display panel, a difference in characteristics of each pixel included in the display panel, and/or the like). Therefore, there may be a limit to perform an over-compensation in which the driving current of the display panel is higher than a desired current level, and/or an under-compensation in which the driving current of the display panel is lower than a desired current level.

The above information disclosed in this Background section is for enhancement of understanding of the background of the present disclosure, and therefore, it may contain information that does not constitute prior art.

SUMMARY

One or more example embodiments of the present disclosure are directed to a display device with improved response speed.

One or more example embodiments of the present disclosure are directed to a method of operating the display device.

According to one or more example embodiments of the present disclosure, a display device, includes: a display panel including a plurality of pixels; a power manager configured to provide a first power supply voltage to the display panel through a first power supply line, and a second power supply voltage to the display panel through a second power supply line, and to measure a first current flowing through the first power supply line and a second current flowing through the second power supply line; and a panel driver configured to provide a panel driving voltage to the display panel, and to control the panel driving voltage according to a current difference between the first current and the second current.

In an example embodiment, each of the pixels may include at least one transistor, the panel driving voltage may include a gate-on voltage to turn on the transistor, and the panel driver may be configured to control the gate-on voltage according to the current difference.

In an example embodiment, the transistor may be a PMOS transistor, and the panel driver may be configured to decrease the gate-on voltage when the current difference is greater than or equal to a reference current difference, and to maintain the gate-on voltage when the current difference is less than the reference current difference.

In an example embodiment, the panel driver may include a gate-on voltage table for storing a voltage level of the gate-on voltage corresponding to the current difference, and the panel driver may be configured to control the gate-on voltage using the gate-on voltage table to provide the gate-on voltage having the voltage level corresponding to the current difference.

In an example embodiment, each of the pixels may include at least one transistor, the panel driving voltage may include a gate-off voltage to turn off the transistor, and the panel driver may be configured to control the gate-off voltage according to the current difference.

In an example embodiment, the transistor may be a PMOS transistor, and the panel driver may be configured to decrease the gate-off voltage when the current difference is greater than or equal to a reference current difference, and to maintain the gate-off voltage when the current difference is less than the reference current difference.

In an example embodiment, the panel driver may include a gate-off voltage table for storing a voltage level of the gate-off voltage corresponding to the current difference, and the panel driver may be configured to control the gate-off voltage using the gate-off voltage table to provide the gate-off voltage having the voltage level corresponding to the current difference.

In an example embodiment, each of the pixels may include an organic light emitting diode, the panel driving voltage may include an initialization voltage to initialize the organic light emitting diode, and the panel driver may be configured to control the initialization voltage according to the current difference.

In an example embodiment, the panel driver may be configured to increase the initialization voltage when the current difference is greater than or equal to a reference current difference, and to maintain the initialization voltage when the current difference is less than the reference current difference.

In an example embodiment, the panel driver may include an initialization voltage table for storing a voltage level of the initialization voltage corresponding to the current difference, and the panel driver may be configured to control the initialization voltage using the initialization voltage table to provide the initialization voltage having the voltage level corresponding to the current difference.

In an example embodiment, the power manager may include: a first power supply circuit configured to provide the first power supply voltage to the display panel through the first power supply line; a second power supply circuit configured to provide the second power supply voltage to the display panel through the second power supply line; a first current measuring circuit connected to the first power supply line, and configured to measure the first current; a second current measuring circuit connected to the second power supply line, and configured to measure the second current; a leakage current calculator configured to calculate the current difference between the first current and the second current; and a compensation signal generator configured to generate a leakage current compensation signal according to the current difference. The panel driver may be configured to control the panel driving voltage in response to the leakage current compensation signal.

In an example embodiment, the display panel may include a display substrate, the power manager may be on a power management substrate at a first side of the display substrate, and the panel driver may be on a panel driving substrate at a second side of the display substrate.

According to one or more example embodiments of the present disclosure, a display device includes: a display panel including a plurality of pixels; a power manager configured to provide a first power supply voltage to the display panel through a first power supply line, and a second power supply voltage to the display panel through a second power supply line, and to measure a first current flowing through the first power supply line and a second current flowing through the second power supply line; and a panel driver configured to provide a gate-on voltage, a gate-off voltage, and an initialization voltage, and to control the gate-on voltage, the gate-off voltage, and the initialization voltage according to a current difference between the first current and the second current.

In an example embodiment, the panel driver may be configured to decrease the gate-on voltage, decrease the gate-off voltage, and increase the initialization voltage when the current difference is greater than or equal to a reference current difference, and the panel driver may be configured to maintain the gate-on voltage, the gate-off voltage, and the initialization voltage when the current difference is less than the reference current difference.

In an example embodiment, the panel driver may include a gate-on voltage table, a gate-off voltage table, and an initialization voltage table, the gate-on voltage table may be configured to store a first voltage level of the gate-on voltage corresponding to the current difference, the gate-off voltage table may be configured to store a second voltage level of the gate-off voltage corresponding to the current difference, the initialization voltage table may be configured to store a third voltage level of the initialization voltage corresponding to the current difference, and the panel driver may be configured to control the gate-on voltage using the gate-on voltage table to provide the gate-on voltage having the first voltage level corresponding to the current difference, to control the gate-off voltage using the gate-off voltage table to provide the gate-off voltage having the second voltage level corresponding to the current difference, and to control the initialization voltage using the initialization voltage table to provide the initialization voltage having the third voltage level corresponding to the current difference.

In an example embodiment, the power manager may include: a first power supply circuit configured to provide the first power supply voltage to the display panel through the first power supply line; a second power supply circuit configured to provide the second power supply voltage to the display panel through the second power supply line; a first current measuring circuit connected to the first power supply line, and configured to measure the first current; a second current measuring circuit connected to the second power supply line, and configured to measure the second current; a leakage current calculator configured to calculate the current difference between the first current and the second current; and a compensation signal generator configured to generate a leakage current compensation signal according to the current difference. The panel driver may be configured to control the gate-on voltage, the gate-off voltage, and the initialization voltage in response to the leakage current compensation signal.

According to one or more example embodiments of the present disclosure, a method of operating a display device, includes: providing a first power supply voltage to a display panel through a first power supply line; providing a second power supply voltage to the display panel through a second power supply line; providing a panel driving voltage to the display panel; measuring a first current flowing through the first power supply line and a second current flowing through the second power supply line; and controlling the panel driving voltage according to a current difference between the first current and the second current.

In an example embodiment, the panel driving voltage may include a gate-on voltage to turn on a transistor, and controlling the panel driving voltage according to the current difference may include: decreasing the gate-on voltage according to the current difference when the current difference is greater than or equal to a reference current difference; and maintaining the gate-on voltage according to the current difference when the current difference is less than the reference current difference.

In an example embodiment, the panel driving voltage may include a gate-off voltage to turn off a transistor, and controlling the panel driving voltage according to the current difference may include: decreasing the gate-off voltage according to the current difference when the current difference is greater than or equal to a reference current difference; and maintaining the gate-off voltage according to the current difference when the current difference is less than the reference current difference.

In an example embodiment, the panel driving voltage may include an initialization voltage to initialize an organic light emitting diode, and controlling the panel driving voltage according to the current difference may include: increasing the initialization voltage according to the current difference when the current difference is greater than or equal to a reference current difference; and maintaining the initialization voltage according to the current difference when the current difference is less than the reference current difference.

According to one or more example embodiments of the present disclosure, a method of operating a display device may be provided that may cause a display panel to generate a driving current having a current level corresponding to a data voltage, because the method may calculate a current difference between a first current flowing through a first power supply line and a second current flowing through a second power supply line, and may control a panel driving voltage (e.g., a gate-on voltage, a gate-off voltage, an initialization voltage, and/or the like) provided to the display panel according to (e.g., based on) the current difference in real time or substantially in real time (e.g., near real time). Therefore, the display device and the method of driving the same according to one or more example embodiments may improve a response speed of the display panel, and may prevent or substantially prevent over-compensation and/or under-compensation of the driving current.

BRIEF DESCRIPTION OF THE DRAWINGS

The above and other aspects and features of the present disclosure will become more apparent to those skilled in the art from the following detailed description of the example embodiments with reference to the accompanying drawings.

FIG. 9 is a diagram illustrating an example of a gate-on voltage table included in the panel driver of FIG. 5.

FIG. 10 is a diagram illustrating an example of a gate-off voltage table included in the panel driver of FIG. 5.

FIG. 11 is a diagram illustrating an example of an initialization voltage table included in the panel driver of FIG. 5.

DETAILED DESCRIPTION

Figure 1:
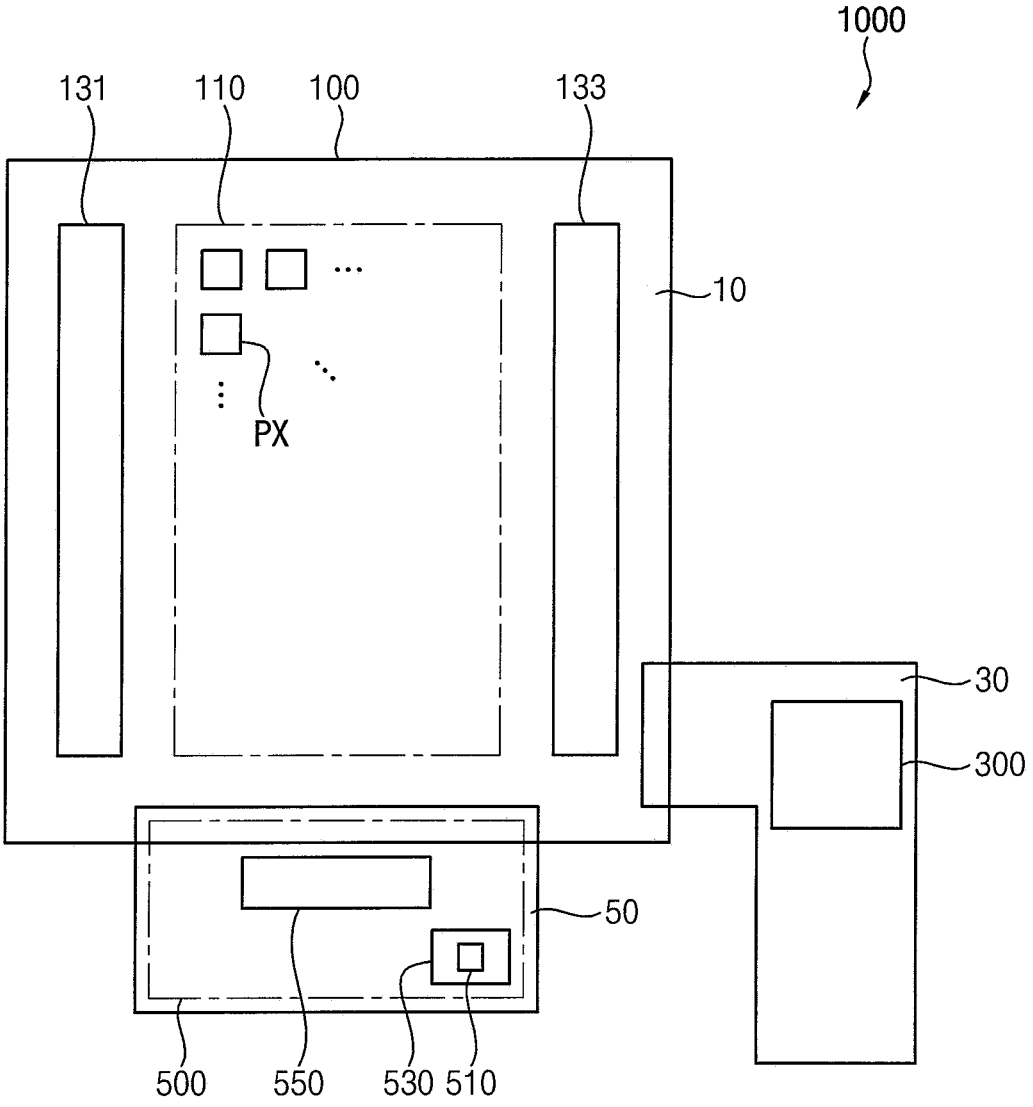
FIG. 1 is a diagram illustrating a display device according to one or more example embodiments.

Hereinafter, example embodiments will be described in more detail with reference to the accompanying drawings, in which like reference numbers refer to like elements throughout. The present disclosure, however, may be embodied in various different forms, and should not be construed as being limited to only the illustrated embodiments herein. Rather, these embodiments are provided as examples so that this disclosure will be thorough and complete, and will fully convey the aspects and features of the present disclosure to those skilled in the art. Accordingly, processes, elements, and techniques that are not necessary to those having ordinary skill in the art for a complete understanding of the aspects and features of the present disclosure may not be described. Unless otherwise noted, like reference numerals denote like elements throughout the attached drawings and the written description, and thus, descriptions thereof may not be repeated.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present disclosure. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present disclosure refers to "one or more embodiments of the present disclosure." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present disclosure belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Figure 2:
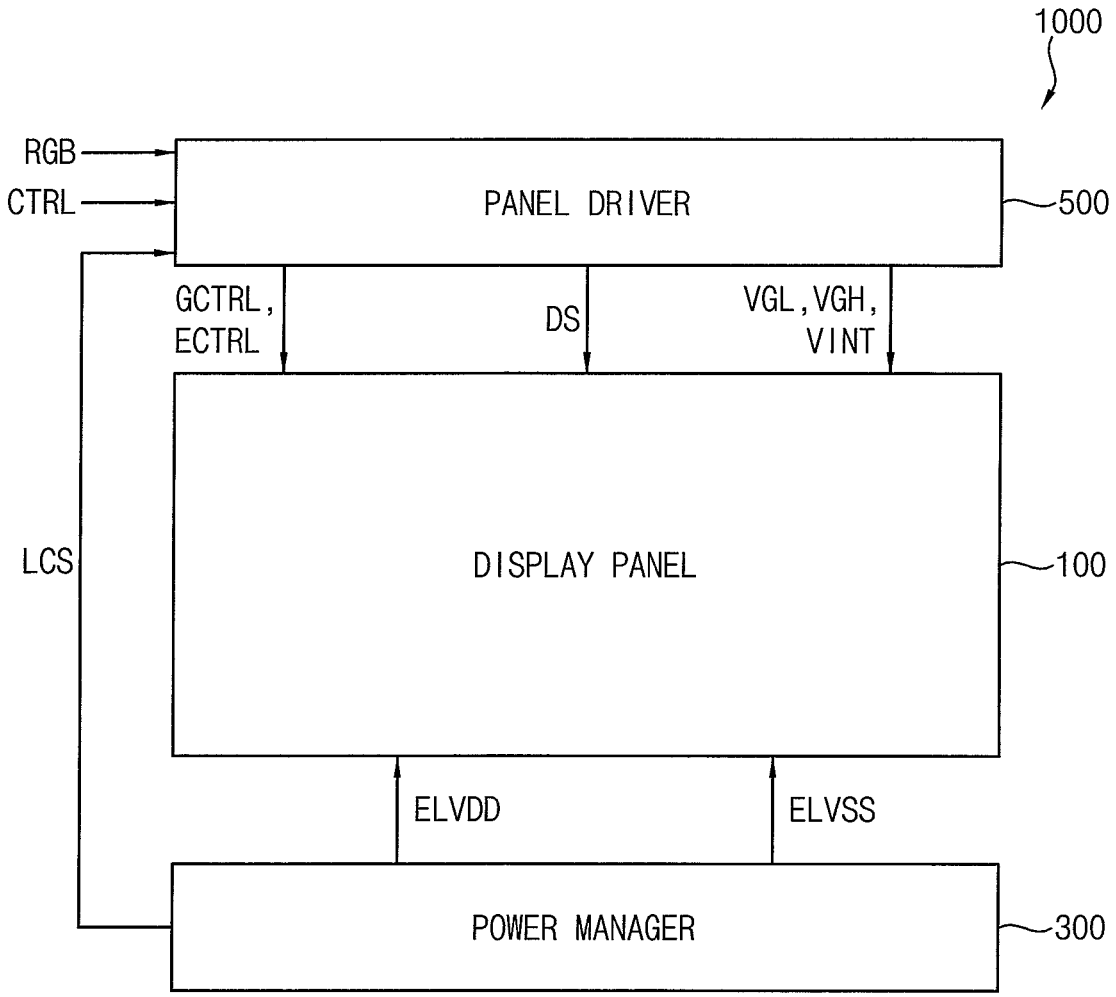
FIG. 2 is a block diagram illustrating the display device of FIG. 1.
Figure 3:
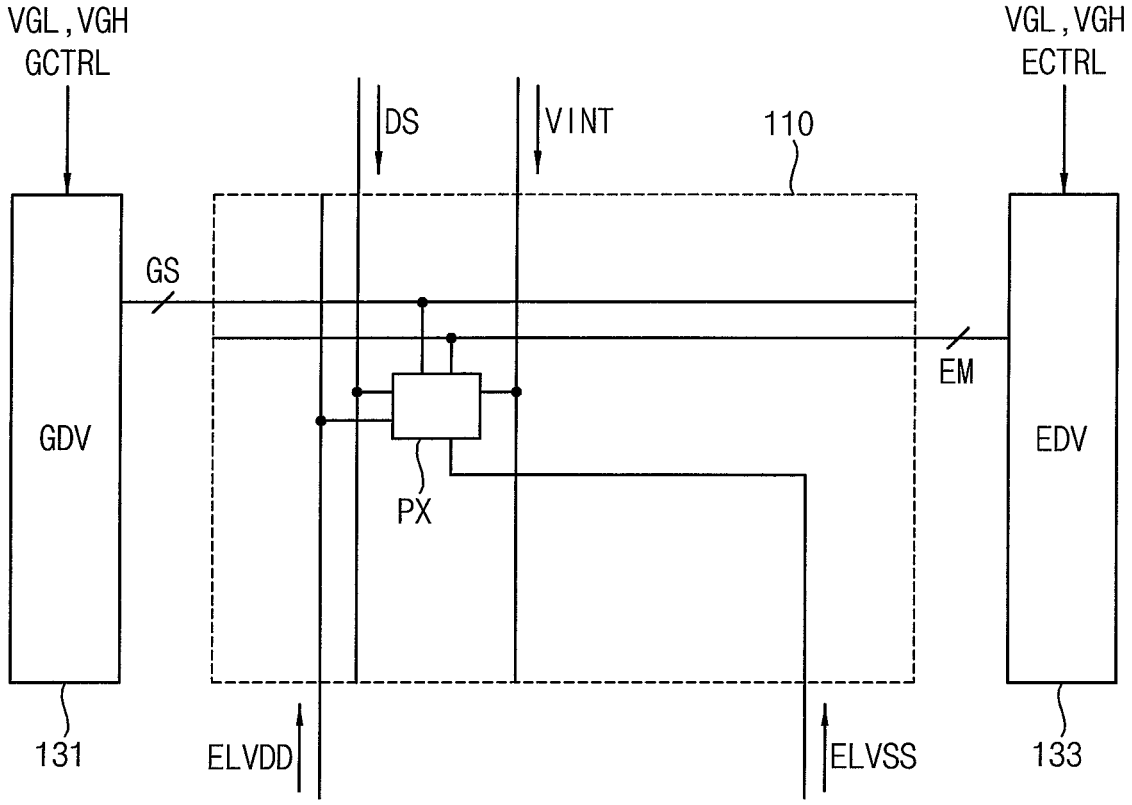
FIG. 3 is a block diagram illustrating an example of a display panel included in the display device of FIG. 1.
Figure 4:
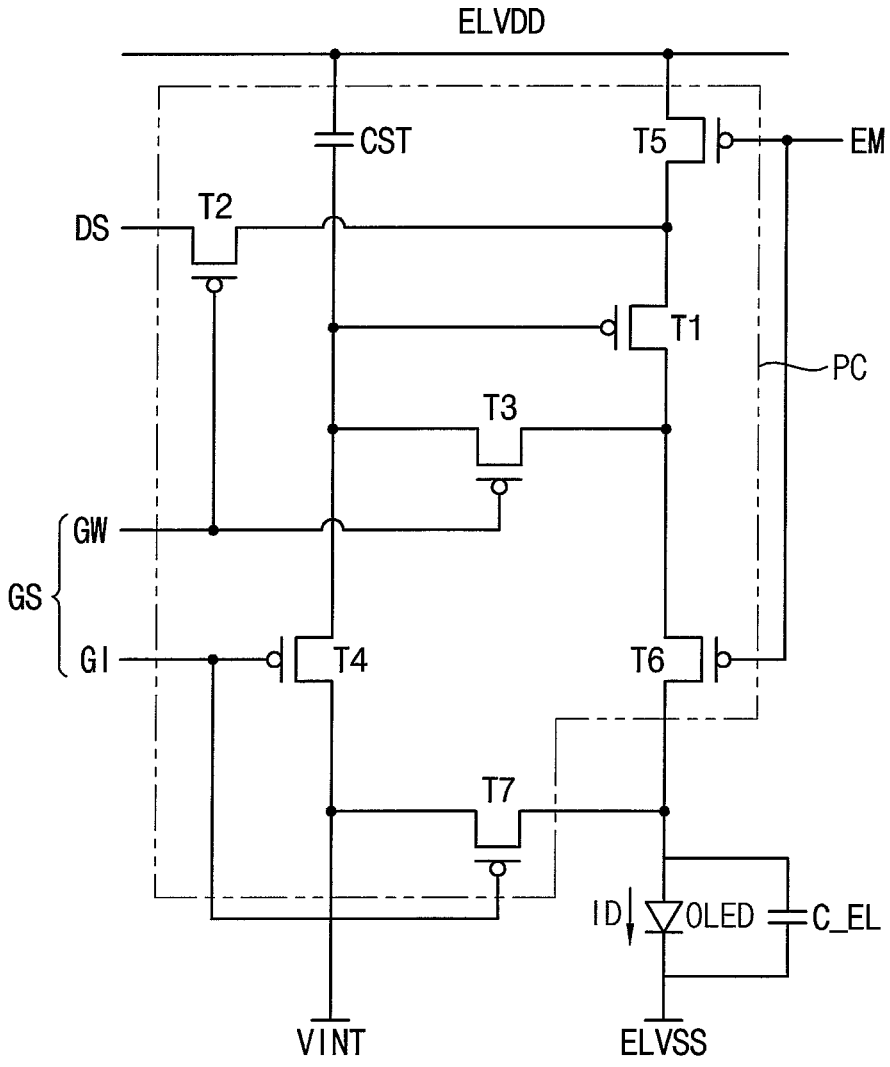
FIG. 4 is a circuit diagram illustrating an example of a pixel included in the display device of FIG. 1.
Figure 5:
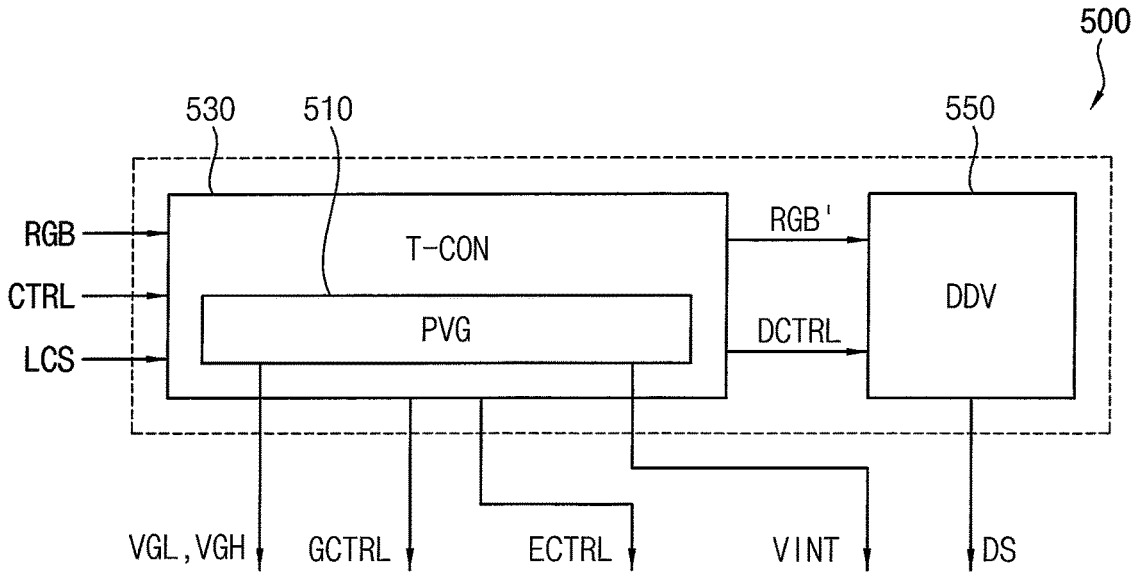
FIG. 5 is a block diagram illustrating an example of a panel driver included in the display device of FIG. 1.
Figure 6:
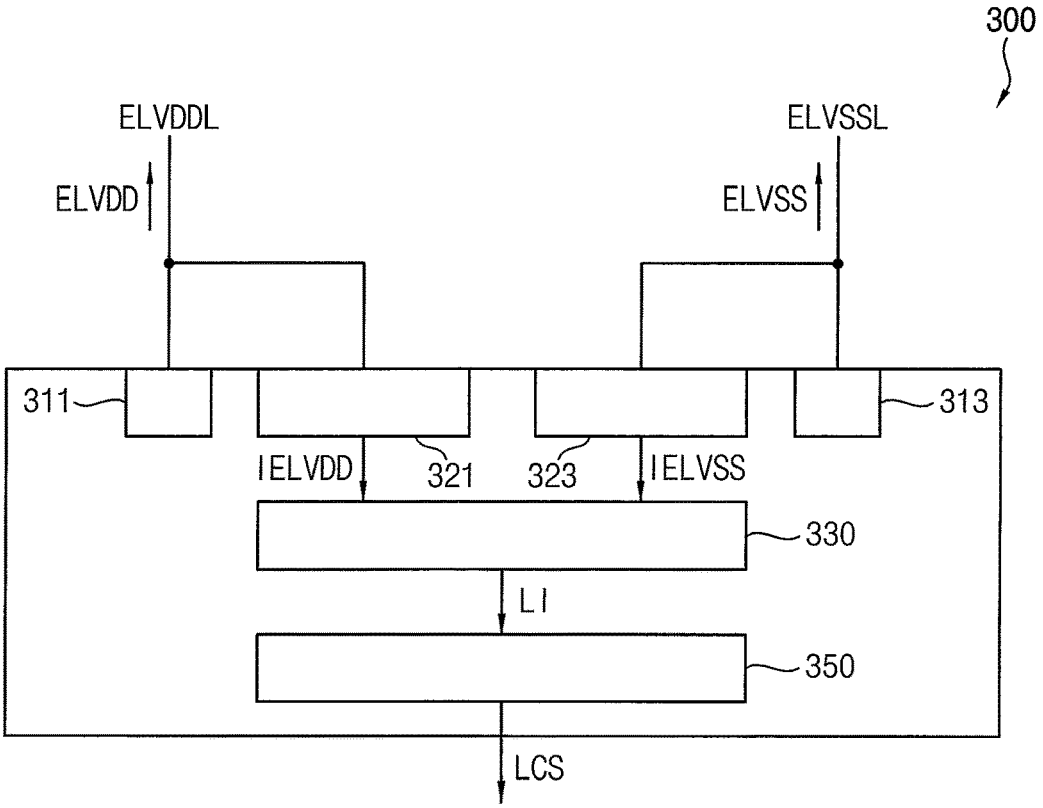
FIG. 6 is a block diagram illustrating an example of a power manager included in the display device of FIG. 1.

FIG. 1 is a diagram illustrating a display device according to one or more example embodiments of the present disclosure. FIG. 2 is a block diagram illustrating the display device of FIG. 1. FIG. 3 is a block diagram illustrating an example of a display panel included in the display device of FIG. 1. FIG. 4 is a circuit diagram illustrating an example of a pixel included in the display device of FIG. 1. FIG. 5 is a block diagram illustrating an example of a panel driver included in the display device of FIG. 1. FIG. 6 is a block diagram illustrating an example of a power manager included in the display device of FIG. 1.

Referring to FIGS. 1 to 6, a display device 1000 may include a display panel 100, a power manager 300, and a panel driver 500. The display panel 100 may include a plurality of pixels PX. The power manager 300 may provide a first power supply voltage ELVDD to the display panel 100 through a first power supply line ELVDDL, may provide a second power supply voltage ELVSS to the display panel 100 through a second power supply line ELVSSL, and may measure a first current IELVDD flowing through the first power supply line ELVDDL and a second current IELVSS flowing through the second power supply line ELVSSL. The panel driver 500 may provide a panel driving voltage to the display panel 100, and may control the panel driving voltage according to (e.g., based on) a current difference LI between the first current IELVDD and the second current IELVSS.

In an example embodiment, as shown in FIG. 1, the display panel 100 may include a display substrate 10. The power manager 300 may be disposed on a power management substrate 30 located at (e.g., on) a first side of the display substrate 10. The panel driver 500 may be disposed on a panel driving substrate 50 located at (e.g., on) a second side of the display substrate 10. For example, the power management substrate 30 may be located at (e.g., on) a right side of the display substrate 10, and the panel driving substrate 50 may be located at (e.g., on) a lower side of the display substrate 10. The display panel 100 may be provided with a signal and a voltage from the power manager 300 and the panel driver 500 through pads disposed between the display substrate 10 and the power management substrate 30, and pads disposed between the display substrate 10 and the panel driving substrate 50.

As shown in FIG. 3, the display panel 100 may include a display part (e.g., a display area) 110 including the pixels PX, a gate driver 131 for providing a gate signal GS to the pixels PX, and an emission driver 133 for providing an emission signal EM to the pixels PX.

The gate driver 131 may be provided with a gate-on voltage VGL, a gate-off voltage VGH, and a gate control signal GCTRL, and may generate the gate signal GS. For example, the gate signal GS may include a first gate signal GW and a second gate signal GI. The gate signal GS may have the gate-on voltage VGL during an active period of the gate signal GS, and may have the gate-off voltage VGH during an inactive period of the gate signal GS. For example, the active period may correspond to (e.g., may be) a period in which a transistor provided with the gate signal GS is turned on, and the inactive period may correspond to (e.g., may be) a period in which the transistor provided with the gate signal GS is turned off. In some example embodiments, the gate driver 131 may be directly mounted on the display panel 100, or may be integrated into a peripheral portion (e.g., a peripheral area or a non-display area) of the display panel 100. In other example embodiments, the gate driver 131 may be connected to the display panel 100 in a form of a chip-on-film (COF).

The emission driver 133 may be provided with a gate-on voltage VGL, a gate-off voltage VGH, and an emission control signal ECTRL, and may generate the emission signal EM. The emission signal EM may have the gate-on voltage VGL during an active period of the emission signal EM, and may have the gate-off voltage VGH during an inactive period of the emission signal EM. For example, the active period may correspond to (e.g., may be) a period in which a transistor provided with the emission signal EM is turned on, and the inactive period may correspond to (e.g., may be) a period in which the transistor provided with the emission signal EM is turned off. In some example embodiments, the emission driver 133 may be directly mounted on the display panel 100, or may be integrated into a peripheral portion (e.g., a peripheral area or a non-display area) of the display panel 100. In other example embodiments, the emission driver 133 may be connected to the display panel 100 in a form of a chip-on-film (COF).

As shown in FIG. 4, each of the pixels PX may include a pixel circuit PC, and an organic light emitting diode OLED electrically connected to the pixel circuit PC. The pixel circuit PC may include first to seventh transistors T1, T2, T3, T4, T5, T6, and T7, and a storage capacitor CST.

The storage capacitor CST may include a first terminal and a second terminal. The first terminal of the storage capacitor CST may be connected to the first transistor T1, and the second terminal of the storage capacitor CST may be provided with the first power supply voltage ELVDD. The storage capacitor CST may maintain or substantially maintain a voltage level of a gate terminal of the first transistor T1 during the inactive period of the first gate signal GW.

The first transistor T1 may include the gate terminal, a first terminal (e.g., a source terminal), and a second terminal (e.g., a drain terminal). The gate terminal of the first transistor T1 may be connected to the first terminal of the storage capacitor CST. The first terminal of the first transistor T1 may be connected to the second transistor T2, and thus, the first terminal of the first transistor T1 may be provided with a data voltage DS. The second terminal of the first transistor T1 may be connected to the organic light emitting diode OLED through the sixth transistor T6. The first transistor T1 may provide a driving current ID to the organic light emitting diode OLED.

The second transistor T2 may include a gate terminal, a first terminal (e.g., a source terminal), and a second terminal (e.g., a drain terminal). The gate terminal of the second transistor T2 may be provided with the first gate signal GW, and the second transistor T2 may be turned on or turned off in response to the first gate signal GW. The first terminal of the second transistor T2 may be provided with the data voltage DS. The second terminal of the second transistor T2 may provide the data voltage DS to the first terminal of the first transistor T1 during a period in which the second transistor T2 is turned on.

The third transistor T3 may include a gate terminal, a first terminal (e.g., a source terminal), and a second terminal (e.g., a drain terminal). The gate terminal of the third transistor T3 may be provided with the first gate signal GW. The first terminal of the third transistor T3 may be connected to the gate terminal of the first transistor T1. The second terminal of the third transistor T3 may be connected to the second terminal of the first transistor T1.

When the third transistor T3 is turned on in response to the first gate signal GW, the third transistor T3 may diode-connect the first transistor T1. As the first transistor T1 is diode-connected, a voltage difference corresponding to a threshold voltage of the first transistor T1 may occur between the gate terminal of the first transistor T1 and the first terminal of the first transistor T1. Accordingly, a voltage obtained by adding the data voltage DS provided to the first terminal of the first transistor T1 during a period in which the third transistor T3 is turned on and the voltage difference corresponding to the threshold voltage may be provided to the gate terminal of the first transistor T1. Therefore, the third transistor T3 may compensate for the threshold voltage of the first transistor T1.

The fourth transistor T4 may include a gate terminal, a first terminal (e.g., a source terminal), and a second terminal (e.g., a drain terminal). The gate terminal of the fourth transistor T4 may be provided with the second gate signal GI. The first terminal of the fourth transistor T4 may be provided with an initialization voltage VINT. The second terminal of the fourth transistor T4 may be connected to the gate terminal of the first transistor T1.

The fourth transistor T4 may be turned on or turned off in response to the second gate signal GI. During a period in which the fourth transistor T4 is turned on, the initialization voltage VINT may be provided to the gate terminal of the first transistor T1. Accordingly, the fourth transistor T4 may initialize the gate terminal of the first transistor T1 to the initialization voltage VINT.

The fifth transistor T5 may include a gate terminal, a first terminal (e.g., a source terminal), and a second terminal (e.g., a drain terminal). The gate terminal of the fifth transistor T5 may be provided with the emission signal EM. The first terminal of the fifth transistor T5 may be provided with the first power supply voltage ELVDD. When the fifth transistor T5 is turned on in response to the emission signal EM, the fifth transistor T5 may provide the first power supply voltage ELVDD to the first transistor T1.

The sixth transistor T6 may include a gate terminal, a first terminal (e.g., a source terminal), and a second terminal (e.g., a drain terminal). The gate terminal of the sixth transistor T6 may be provided with the emission signal EM. The first terminal of the sixth transistor T6 may be connected to the second terminal of the first transistor T1. When the sixth transistor T6 is turned on in response to the emission signal EM, the sixth transistor T6 may transfer the driving current ID to the organic light emitting diode OLED.

The seventh transistor T7 may include a gate terminal, a first terminal (e.g., a source terminal), and a second terminal (e.g., a drain terminal). The gate terminal of the seventh transistor T7 may be provided with the second gate signal GI. The first terminal of the seventh transistor T7 may be provided with the initialization voltage VINT. The second terminal of the seventh transistor T7 may be connected to a first terminal of the organic light emitting diode OLED. When the seventh transistor T7 is turned on in response to the second gate signal GI, the seventh transistor T7 may provide the initialization voltage VINT to the organic light emitting diode OLED. In other words, the seventh transistor T7 may provide the initialization voltage VINT to a parasitic capacitor C_EL of the organic light emitting diode OLED, and the initialization voltage VINT may initialize (e.g., may discharge) the parasitic capacitor C_EL of the organic light emitting diode OLED.

In various embodiments, each of the first to seventh transistors T1, T2, T3, T4, T5, T6, and T7 may be a PMOS transistor or an NMOS transistor. For example, in a case where the fifth transistor T5 is the PMOS transistor, the fifth transistor T5 may be turned on when the emission signal EM has a negative voltage level, and may be turned off when the emission signal EM has a positive voltage level. On the other hand, in a case where the fifth transistor T5 is the NMOS transistor, the fifth transistor T5 may be turned on when the emission signal EM has the positive voltage level, and may be turned off when the emission signal EM has the negative voltage level.

A voltage that turns on the transistor may be defined as the gate-on voltage. For example, when the transistor is the PMOS transistor, the gate-on voltage VGL may have the positive voltage level. Hereinafter, the transistors (e.g. T2, T3, T4, T5, T6, and T7) provided with the gate signal GS or the emission signal EM are described as the PMOS transistors for convenience of description, but the present disclosure is not limited thereto.

A connection structure of the pixel circuit PC shown in FIG. 4 may be an illustrative example, and thus, may be variously modified as would be apparent to those having ordinary skill in the art. For example, when the pixel circuit PC does not include the third to seventh transistors T3, T4, T5, T6, and T7, the connection structure of the other components in the pixel circuit PC shown in FIG. 4 may be variously modified to form a suitable connection structure of the components in the pixel circuit PC.

The organic light emitting diode OLED may include the first terminal (e.g., an anode terminal) and a second terminal (e.g., a cathode terminal). The first terminal of the organic light emitting diode OLED may be connected to the first transistor T1 through the sixth transistor T6, and the second terminal of the organic light emitting diode OLED may be provided with the second power supply voltage ELVSS. The organic light emitting diode OLED may be provided with the driving current ID from the first transistor T1. While the organic light emitting diode OLED emits light according to (e.g., based on) the driving current ID, the parasitic capacitor C_EL may be charged by a voltage provided to the organic light emitting diode OLED. Accordingly, a current provided from the first transistor T1 may be divided into a leakage current provided to the parasitic capacitor C_EL and the driving current ID provided to the organic light emitting diode OLED. In other words, as the leakage current is provided to the parasitic capacitor C_EL, the organic light emitting diode OLED may be provided with the driving current ID that is smaller than (e.g., less than) a desired current corresponding to the data voltage DS provided by the first transistor T1. Accordingly, the display panel 100 may display an image with a luminance lower than a desired luminance corresponding to the data voltage DS. On the other hand, in the display device 1000 according to one or more example embodiments of the present disclosure, although the leakage current may be provided to the parasitic capacitor C_EL, the display panel 100 may display an image with a luminance that is the same or substantially the same as (e.g., close to or near) the desired luminance corresponding to the data voltage DS, by controlling the panel driving voltage such that the driving current ID approaches (e.g., is increased or decreased to) a desired current level corresponding to the data voltage DS.

As shown in FIG. 5, the panel driver 500 may be provided with input image data RGB and a control signal CTRL from an external device (e.g., a graphics processor), and may be provided with a leakage current compensation signal LCS from the power manager 300. The panel driver 500 may generate a gate control signal GCTRL, an emission control signal ECTRL, the data voltage DS, and the panel driving voltage based on the provided data and signals, and may provide the gate control signal GCTRL, the emission control signal ECTRL, the data voltage DS, and the panel driving voltage to the display panel 100. The panel driving voltage may include the gate-on voltage VGL, the gate-off voltage VGH, and the initialization voltage VINT.

For example, the panel driver 500 may include a panel driving voltage generator 510, a timing controller 530, and a data driver 550. In an example embodiment, the panel driver 500 may be disposed on the panel driving substrate 50 located at (e.g., on) the second side of the display substrate 10. For example, the panel driving substrate 50 may be located below the display substrate 10, and signals and voltages generated by the panel driving voltage generator 510, the timing controller 530, and the data driver 550 may be provided to the display panel 100 through the pads that electrically connect the panel driving substrate 50 and the display substrate 10 to each other.

The panel driving voltage generator 510 may generate the gate-on voltage VGL, the gate-off voltage VGH, and the initialization voltage VINT. In addition, the panel driving voltage generator 510 may control the gate-on voltage VGL, the gate-off voltage VGH, and the initialization voltage VINT according to (e.g., based on) the leakage current compensation signal LCS. The leakage current compensation signal LCS may be generated according to (e.g., based on) the current difference LI between the first current IELVDD and the second current IELVSS. In other words, the gate-on voltage VGL, the gate-off voltage VGH, and the initialization voltage VINT may be controlled according to (e.g., based on) the current difference LI between the first current IELVDD and the second current IELVSS, which will be described in more detail below with reference to FIGS. 7 to 11.

The timing controller 530 may be provided with the input image data RGB and the control signal CTRL from the external device, and may be provided with the leakage current compensation signal LCS from the power manager 300. For example, the input image data RGB may correspond to (e.g., may be) RGB image data including a red image data, a green image data, and a blue image data. The control signal CTRL may include a vertical sync signal, a horizontal sync signal, an input data enable signal, a master clock signal, and/or the like. The timing controller 530 may generate image data RGB', a data control signal DCTRL, the gate control signal GCTRL, and the emission control signal ECTRL according to (e.g., based on) the input image data RGB, the control signal CTRL, and the leakage current compensation signal LCS.

The data driver 550 may generate the data voltage DS according to (e.g., based on) the image data RGB' and the data control signal DCTRL provided from the timing controller 530, and may provide the data driver DS to the pixels PX. In an example embodiment, the data driver 550 may be connected to the display panel in the form of a COF. In another example embodiment, the data driver 550 may be directly mounted on the display panel 100, or may be integrated into a peripheral portion (e.g., a peripheral area or a non-display area) of the display panel 100.

As shown in FIG. 6, the power manager 300 may provide the first power supply voltage ELVDD to the display panel 100 through the first power supply line ELVDDL, and the second power supply voltage ELVSS to the display panel 100 through the second power supply line ELVSSL. In addition, the power manager 300 may measure the first current IELVDD flowing through the first power supply line ELVDDL, and the second current IELVSS flowing through the second power supply line ELVSSL. Further, the power manager 300 may generate the leakage current compensation signal LCS according to (e.g., based on) the current difference LI between the first current IELVDD and the second current IELVSS, and may provide the leakage current compensation signal LCS to the panel driver 500. In an example embodiment, the power manager 300 may be disposed on the power management substrate 30 located at (e.g., on) the first side of the display substrate 10. For example, as described above, the power management substrate 30 may be located at (e.g., on) the right side of the display substrate 10.

For example, the power manager 300 may include a first power supply circuit 311 and a second power supply circuit 313. The first power supply circuit 311 may provide the first power supply voltage ELVDD to the display panel 100 through the first power supply line ELVDDL. The second power supply circuit 313 may provide the second power supply voltage ELVSS to the display panel 100 through the second power supply line ELVSSL. In an example embodiment, the first power supply voltage ELVDD may be a high power supply voltage, the second power supply voltage ELVSS may be a low power supply voltage, and the first power supply voltage ELVDD may be higher than the second power supply voltage ELVSS.

In some embodiments, the power manager 300 may further include a first current measuring circuit 321, a second current measuring circuit 323, a leakage current calculator 330, and a compensation signal generator 350. The first current measuring circuit 321 may be connected to the first power supply line ELVDDL, and may measure the first current IELVDD flowing through the first power supply line ELVDDL. The second current measuring circuit 323 may be connected to the second power supply line ELVSSL, and may measure the second current IELVSS flowing through the second power supply line ELVSSL. The leakage current calculator 330 may calculate the current difference LI between the first current IELVDD and the second current IELVSS. The compensation signal generator 350 may be provided with the current difference LI, and may generate the leakage current compensation signal LCS. The compensation signal generator 350 may provide the leakage current compensation signal LCS to the panel driver 500.

Figure 7:
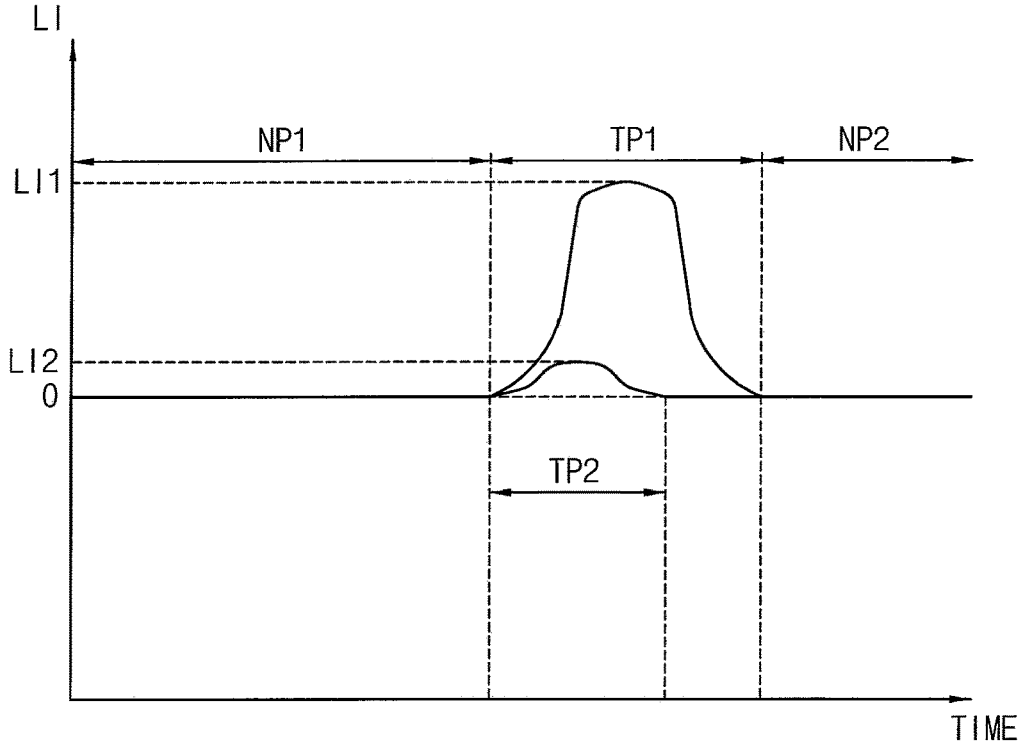
FIG. 7 is a diagram illustrating a current difference between a first current and a second current.
Figure 8:
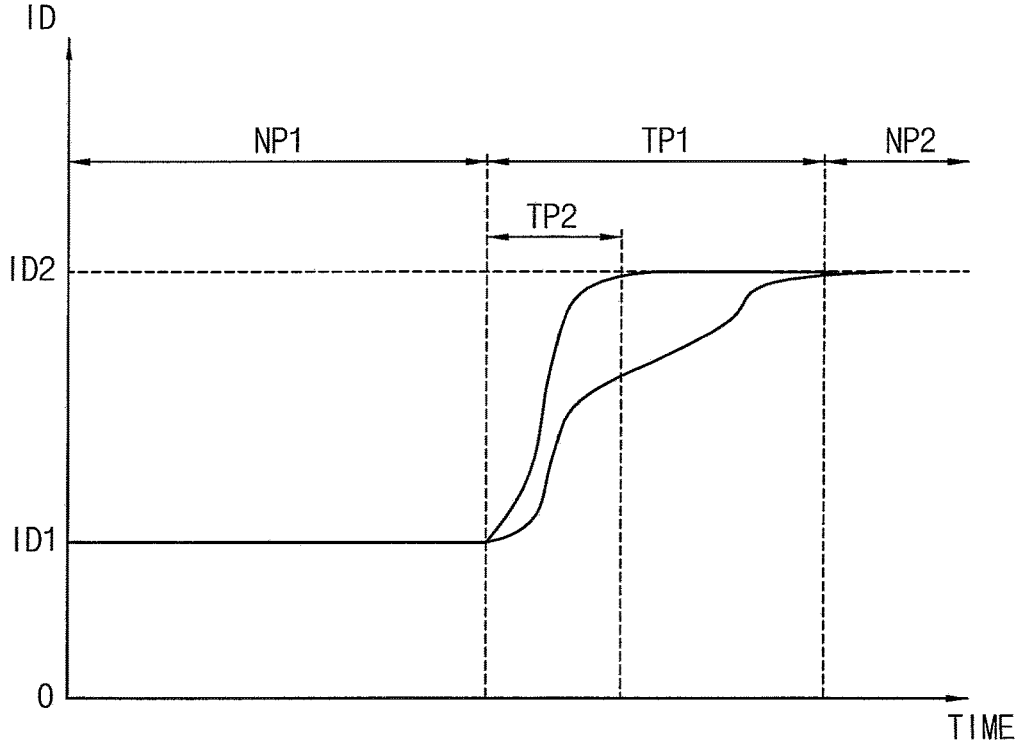
FIG. 8 is a diagram illustrating a driving current based on the current difference of FIG. 7.

FIG. 7 is a diagram illustrating a current difference between a first current and a second current. FIG. 8 is a diagram illustrating a driving current based on the current difference of FIG. 7.

Referring to FIGS. 2, 4, 6, 7, and 8, a comparative display device may include a display panel and a panel driver. The display panel may be provided with a data voltage from the panel driver, may generate a first driving current ID1 corresponding to the data voltage, and may display the image with a luminance corresponding to the data voltage during a first normal period NP1. However, when an image to be displayed on the display panel is changed (for example, when the image is changed from a black image to a white image), the panel driver provides a changed data voltage to the display panel, and the display panel may generate a changed second driving current ID2. In this case, as a leakage current occurs inside the display panel, a first current difference LI1 may occur between the first current provided (or input) to the display panel and the second current provided (or output) from the display panel, and a certain time may be required to generate the changed second driving current ID2. The certain time may be a first transient period TP1 between the first normal period NP1 and a second normal period NP2. In other words, a response speed of the display panel may be delayed by the leakage current. In addition, to improve the response speed of the display panel, the comparative display device may use an operating method for calculating the driving current during the first transient period TP1 and increasing the data voltage accordingly, but the operating method of the comparative display device does not take into account driving conditions of the comparative display device (e.g., a temperature change of the display panel, a difference in characteristics of each pixel included in the display panel, and/or the like). Therefore, the operating method of the comparative display device may result in an over-compensation in which the driving current of the display panel has a current level higher than a desired current level, and/or an under-compensation in which the driving current has a current level lower than the desired current level.

FIG. 9 is a diagram illustrating an example of a gate-on voltage table included in the panel driver of FIG. 5. FIG. 10 is a diagram illustrating an example of a gate-off voltage table included in the panel driver of FIG. 5. FIG. 11 is a diagram illustrating an example of an initialization voltage table included in the panel driver of FIG. 5.

Referring to FIGS. 2, 4, 5, 6, 7, 8, and 9, the panel driver 500 according to one or more example embodiments of the present disclosure may control the gate-on voltage VGL according to (e.g., based on) the current difference LI.

For example, the panel driving voltage generator 510 may be provided with the leakage current compensation signal LCS from the power manager 300, and may control the gate-on voltage VGL in response to the leakage current compensation signal LCS. In other words, the panel driving voltage generator 510 may control the gate-on voltage VGL according to (e.g., based on) the first current difference LI1.

In an example embodiment, when the first current difference LI1 is greater than or equal to a reference current difference LI_S, the panel driving voltage generator 510 may decrease the gate-on voltage VGL. For example, when the reference current difference LI_S is about 2 mA and the first current difference LI1 is about 2.83 mA, the panel driving voltage generator 510 may decrease the gate-on voltage VGL. In another example, when the first current difference LI1 is smaller than the reference current difference LI_S, the panel driving voltage generator 510 may maintain or substantially maintain the gate-on voltage VGL. For example, when the reference current difference LI_S is about 2 mA and the first current difference LI1 is about 1 mA, the panel driving voltage generator 510 may maintain the gate-on voltage VGL at a previously generated gate-on voltage VGL. The reference current difference LI_S may be appropriately determined (e.g., set or predetermined) as necessary or desired.

In another example embodiment, the panel driving voltage generator 510 may include a gate-on voltage table VGL_TB for storing a first voltage level of the gate-on voltage VGL corresponding to the first current difference LI1. In this case, the panel driving voltage generator 510 may control the gate-on voltage VGL using the gate-on voltage table VGL_TB, so that the gate-on voltage VGL has the first voltage level corresponding to the first current difference LI1. For example, as shown in FIG. 9, when the first current difference LI1 (e.g., corresponding to LI shown in FIG. 9) is about 0 mA, the first voltage level of the gate-on voltage VGL generated by the panel driving voltage generator 510 may be about −10V. In another example, when the first current difference LI1 is about 2.83 mA, the first voltage level of the gate-on voltage VGL generated by the panel driving voltage generator 510 may be about −10.4V.

Because the panel driving voltage generator 510 may control the gate-on voltage VGL according to (e.g., based on) the first current difference LI1, a turn-on characteristic of a transistor provided with the gate-on voltage VGL may be improved. Because the turn-on characteristic of the transistor provided with the gate-on voltage VGL in the pixel circuit PC is improved, the transistor may transfer more current, and the driving current ID of the display panel 100 may be increased. Accordingly, because the gate-on voltage VGL provided to the display panel 100 is controlled, as shown in FIG. 7, the first current difference LI1 may be decreased to a second current difference LI2 by the controlled gate-on voltage VGL, and the first transient period TP1 may be shortened to a second transient period TP2 by the controlled gate-on voltage VGL. In other words, as shown in FIG. 8, a time to change from the first driving current ID1 to the second driving current ID2 may be reduced (e.g., may be shortened).

Referring to FIGS. 2, 4, 5, 6, 7, 8, and 10, the panel driver 500 according to one or more example embodiments of the present disclosure may control the gate-off voltage VGH according to (e.g., based on) the current difference LI.

For example, the panel driving voltage generator 510 may be provided with the leakage current compensation signal LCS from the power manager 300, and may control the gate-off voltage VGH in response to the leakage current compensation signal LCS. In other words, the panel driving voltage generator 510 may control the gate-off voltage VGH according to (e.g., based on) the first current difference LI1.

In an example embodiment, when the first current difference LI1 is greater than or equal to the reference current difference LI_S, the panel driving voltage generator 510 may decrease the gate-off voltage VGH. For example, when the reference current difference LIS is about 7 mA and the first current difference LI1 is about 7.08 mA, the panel driving voltage generator 510 may decrease the gate-off voltage VGH. In another example, when the first current difference LI1 is smaller than (e.g., less than) the reference current difference LI_S, the panel driving voltage generator 510 may maintain or substantially maintain the gate-off voltage VGH. For example, when the reference current difference LI_S is about 7 mA and the first current difference LI1 is about 6 mA, the panel driving voltage generator 510 may maintain or substantially maintain the gate-off voltage VGH at a previously generated gate-off voltage VGH. The reference current difference LI_S may be appropriately determined (e.g., set or predetermined) as necessary or desired.

In another example embodiment, the panel driving voltage generator 510 may include a gate-off voltage table VGH_TB for storing a second voltage level of the gate-off voltage VGH corresponding to the first current difference LI1. In this case, the panel driving voltage generator 510 may control the gate-off voltage VGH using the gate-off voltage table VGH_TB so that the gate-off voltage VGH has the second voltage level corresponding to the first current difference LI1. For example, as shown in FIG. 10, when the first current difference LI1 (e.g., corresponding to LI shown in FIG. 10) is about 0 mA, the second voltage level of the gate-off voltage VGH generated by the panel driving voltage generator 510 may be about 6V. In another example, when the first current difference LI1 is about 7.08 mA, the second voltage level of the gate-off voltage VGH generated by the panel driving voltage generator 510 may be about 5.5V.

Because the panel driving voltage generator 510 may control the gate-off voltage VGH according to (e.g., based on) the first current difference LI1, a turn-off characteristic of a transistor provided with the gate-off voltage VGH may be weakened. Because the turn-off characteristic of the transistor provided with the gate-off voltage VGH in the pixel circuit PC is weakened, the transistor may transfer a current even during the inactive period, and the driving current ID of the display panel 100 may be increased. Accordingly, because the gate-off voltage VGH provided to the display panel 100 is controlled, as shown in FIG. 7, the first current difference LI1 may be decreased to a second current difference LI2 by the controlled gate-off voltage VGH, and the first transient period TP1 may be shortened to the second transient period TP2 by the controlled gate-off voltage VGH. In other words, as shown in FIG. 8, a time to change from the first driving current ID1 to the second driving current ID2 may be decreased (e.g., may be shortened).

Although the transistor provided with the gate-on voltage VGL and the gate-off voltage VGH is described as the PMOS transistor, the present disclosure is not limited thereto. For example, in a case where the transistor provided with the gate-on voltage VGL and the gate-off voltage VGH is the NMOS transistor, the panel driver 500 may increase the gate-on voltage VGL and/or the gate-off voltage VGH according to (e.g., based on) the current difference LI. In this case, because the gate-on voltage VGL and/or the gate-off voltage VGH are increased, the turn-on characteristic of the transistor provided with the gate-on voltage VGL may be improved, and the turn-off characteristic of the transistor provided with the gate-off voltage VGH may be weakened.

Referring to FIGS. 2, 4, 5, 6, 7, 8, and 11, the panel driver 500 according to one or more example embodiments of the present disclosure may control the initialization voltage VINT according to (e.g., based on) the current difference LI.

For example, the panel driving voltage generator 510 may be provided with the leakage current compensation signal LCS from the power manager 300, and may control the initialization voltage VINT in response to the leakage current compensation signal LCS. In other words, the panel driving voltage generator 510 may control the initialization voltage VINT according to (e.g., based on) the first current difference LI1.

In an example embodiment, when the first current difference LI1 is greater than or equal to the reference current difference LI_S, the panel driving voltage generator 510 may increase the initialization voltage VINT. For example, when the reference current difference LI_S is about 5 mA and the first current difference LI1 is about 8 mA, the panel driving voltage generator 510 may increase the initialization voltage VINT. In another example, when the first current difference LI1 is smaller than the reference current difference LI_S, the panel driving voltage generator 510 may maintain or substantially maintain the initialization voltage VINT. For example, when the reference current difference LI_S is about 5 mA and the first current difference LI1 is about 4 mA, the panel driving voltage generator 510 may maintain or substantially maintain the initialization voltage VINT at a previously generated initialization voltage VINT. The reference current difference LI_S may be appropriately determined (e.g., set or predetermined) as necessary or desired.

In another example embodiment, the panel driving voltage generator 510 may include an initialization voltage table VINT_TB for storing a third voltage level of the initialization voltage VINT corresponding to the first current difference LI1. In this case, the panel driving voltage generator 510 may control the initialization voltage VINT using the initialization voltage table VINT_TB so that the initialization voltage VINT has the third voltage level corresponding to the first current difference LI1. For example, as shown in FIG. 11, when the first current difference LI1 (e.g., corresponding to LI shown in FIG. 11) is about 0 mA, the third voltage level of the initialization voltage VINT generated by the panel driving voltage generator 510 may be about −5V. In another example, when the first current difference LI1 is about 8 mA, the third voltage level of the initialization voltage VINT generated by the panel driving voltage generator 510 may be about −4.5V.

Because the panel driving voltage generator 510 may control the initialization voltage VINT according to (e.g., based on) the first current difference LI1, the parasitic capacitor C_EL of the organic light emitting diode OLED provided with the initialization voltage VINT may be relatively less initialized (e.g., less discharged). Accordingly, a current may remain in the parasitic capacitor C_EL of the organic light emitting diode OLED, and the driving current ID of the display panel 100 may be increased. Because the initialization voltage VINT provided to the display panel 100 is controlled, as shown in FIG. 7, the first current difference LI1 may be decreased to the second current difference LI2 by the controlled initialization voltage VINT, and the first transient period TP1 may be shortened to the second transient period TP2 by the controlled initialization voltage VINT. In other words, as shown in FIG. 8, a time to change from the first driving current ID1 to the second driving current ID2 may be reduced (e.g., may be shortened).

To improve a response speed of a display panel, a comparative operating method calculates a driving current during the first transient period TP1 and increases a data voltage accordingly. However, the comparative operating method does not take into account driving conditions of the display device (e.g., a temperature change of the display panel, a difference in characteristics of each pixel included in the display panel, and/or the like). Therefore, the comparative operating method may result in an over-compensation in which the driving current of the display panel has a current level higher than a desired current level, and/or an under-compensation in which the driving current has a current level lower than the desired current level.

On the other hand, the display device 1000 according to one or more example embodiments of the present disclosure may calculate the first current difference LI1, which may correspond to (e.g., may be) a current difference before compensation, corresponding to the leakage current during the transient period, and may control the gate-on voltage VGL, gate-off voltage VGH, and/or the initialization voltage VINT in real time based on the first current difference LI1. Accordingly, the controlled gate-on voltage VGL, the controlled gate-off voltage VGH, and/or the controlled initialization voltage VINT may be provided to the display panel 100 during the second transient period TP2, which may correspond to (e.g., may be) a transient period after compensation. Because the second transient period TP2 is shortened, the response speed of the display panel 100 may be improved. In addition, because the display device 1000 may control the gate-on voltage VGL, the gate-off voltage VGH, and/or the initialization voltage VINT according to (e.g., based on) the current difference LI that is measured in real time, the display device 1000 may prevent or substantially prevent the over-compensation and/or the under-compensation of the driving current ID.

While the panel driver 500 according to one or more example embodiments of the present disclosure is described as controlling any one or more of the gate-on voltage VGL, the gate-off voltage VGH, and the initialization voltage VINT, the present disclosure is not limited thereto. For example, in some embodiments, the panel driver 500 may control each of the gate-on voltage VGL, the gate-off voltage VGH, and the initialization voltage VINT together according to (e.g., based on) the current difference LI between the first current IELVDD and the second current IELVSS.

In an example embodiment, when the current difference LI is greater than or equal to the reference current difference LI_S, the panel driver 500 may decrease the gate-on voltage VGL, may decrease the gate-off voltage VGH, and/or may increase the initialization voltage VINT. Further, when the current difference LI is smaller than the reference current difference LI_S, the panel driver 500 may maintain or substantially maintain the gate-on voltage VGL, the gate-off voltage VGH, and/or the initialization voltage VINT.

In another example embodiment, the panel driver 500 may include the gate-on voltage table for storing a first voltage level of the gate-on voltage VGL corresponding to the current difference LI, the gate-off voltage table for storing a second voltage level of the gate-off voltage VGH corresponding to the current difference LI, and/or the initialization voltage table for storing a third voltage level of the initialization voltage VINT corresponding to the current difference LI. The panel driver 500 may control the gate-on voltage VGL, the gate-off voltage VGH, and/or the initialization voltage VINT using the gate-on voltage table, the gate-off voltage table, and/or the initialization voltage table, respectively.

Figure 12:
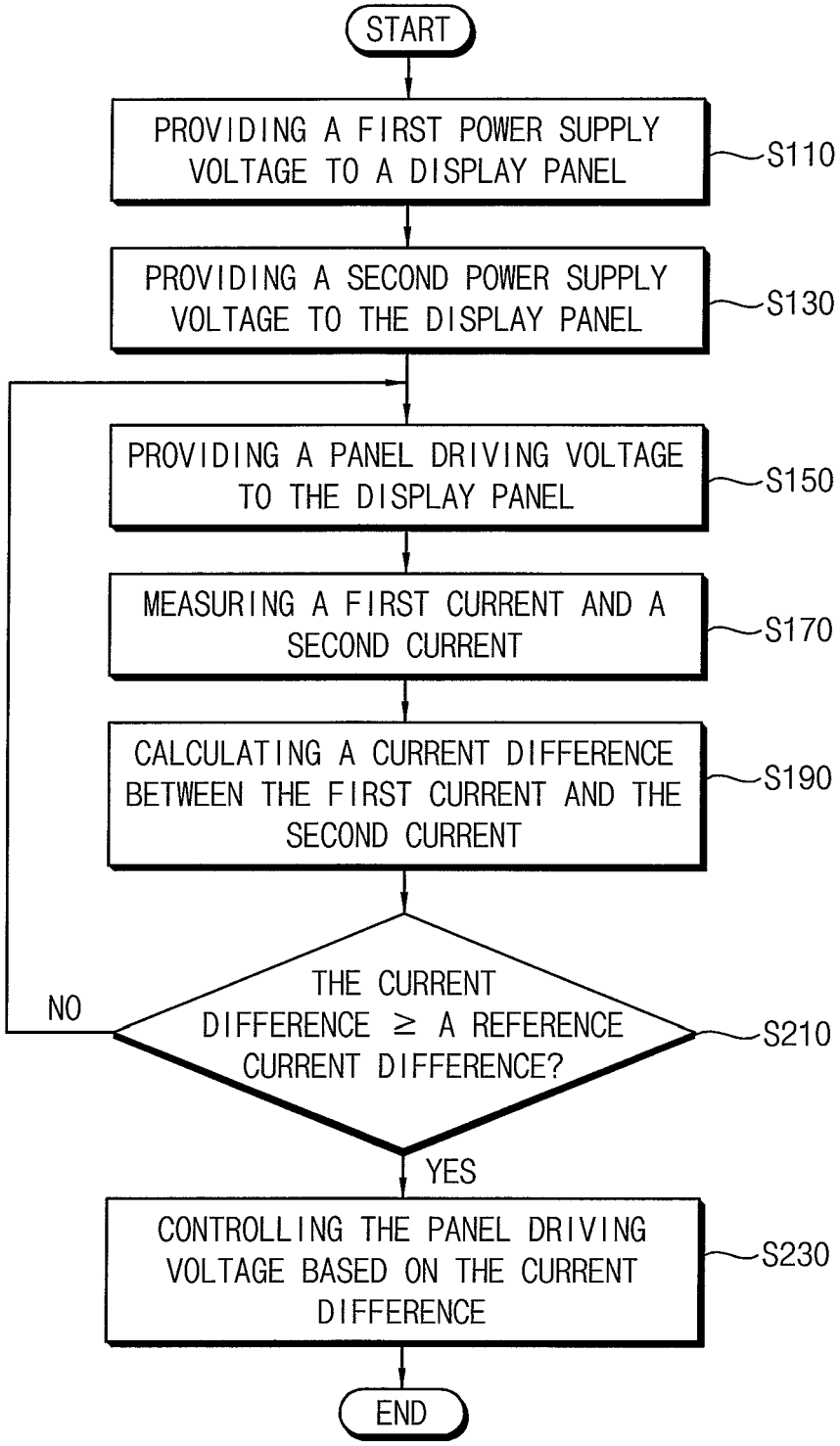
FIG. 12 is a flowchart illustrating a method of operating a display device according to one or more example embodiments.

FIG. 12 is a flowchart illustrating a method of operating a display device according to one or more example embodiments.

Referring to FIGS. 2, 3, 5, 6, and 12, in the method of operating the display device according to one or more example embodiments, the power manager 300 may provide the first power supply voltage ELVDD to the display panel 100 through the first power supply line ELVDDL (S110). In addition, the power manager 300 may provide the second power supply voltage ELVSS to the display panel 100 through the second power supply line ELVSSL (S130). In an example embodiment, the first power supply voltage ELVDD may be a high power supply voltage for driving the pixels PX, the second power supply voltage ELVSS may be a low power supply voltage for driving the pixels PX, and the first power supply voltage ELVDD may be higher than the second power supply voltage ELVSS.

The panel driver 500 may provide the panel driving voltage to the display panel 100 (S150). In an example embodiment, the panel driving voltage may include the gate-on voltage VGL, the gate-off voltage VGH, and/or the initialization voltage VINT.

The power manager 300 may measure the first current IELVDD flowing through the first power supply line ELVDDL, and the second current IELVSS flowing through the second power supply line ELVSSL (S170). For example, the power manager 300 may include the first and second current measuring circuits 321 and 323 that are electrically connected to the first and second power supply lines ELVDDL and ELVSSL, respectively. The power manager 300 may calculate the current difference LI between the first current IELVDD and the second current IELVSS (S190). For example, the power manager 300 may include the leakage current calculator 330 to calculate the current difference.

In an example embodiment, the panel driver 500 may compare the current difference LI and a reference current difference to determine whether the current difference LI is greater than or equal to the reference current difference (S210). When the current difference LI is smaller than the reference current difference (S210: NO), the panel driver 500 may maintain or substantially maintain the panel driving voltage so that the panel driver 500 provides the panel driving voltage to the display panel 100 (S150). On the other hand, when the current difference LI is greater than or equal to the reference current difference (S210: YES), the panel driver 500 may control the panel driving voltage according to (e.g., based on) the current difference LI (S230). The method in which the panel driver 500 controls the panel driving voltage according to (e.g., based on) the current difference LI has been described with reference to FIGS. 1 to 11, and thus, redundant description thereof may not be repeated.

Figure 13:
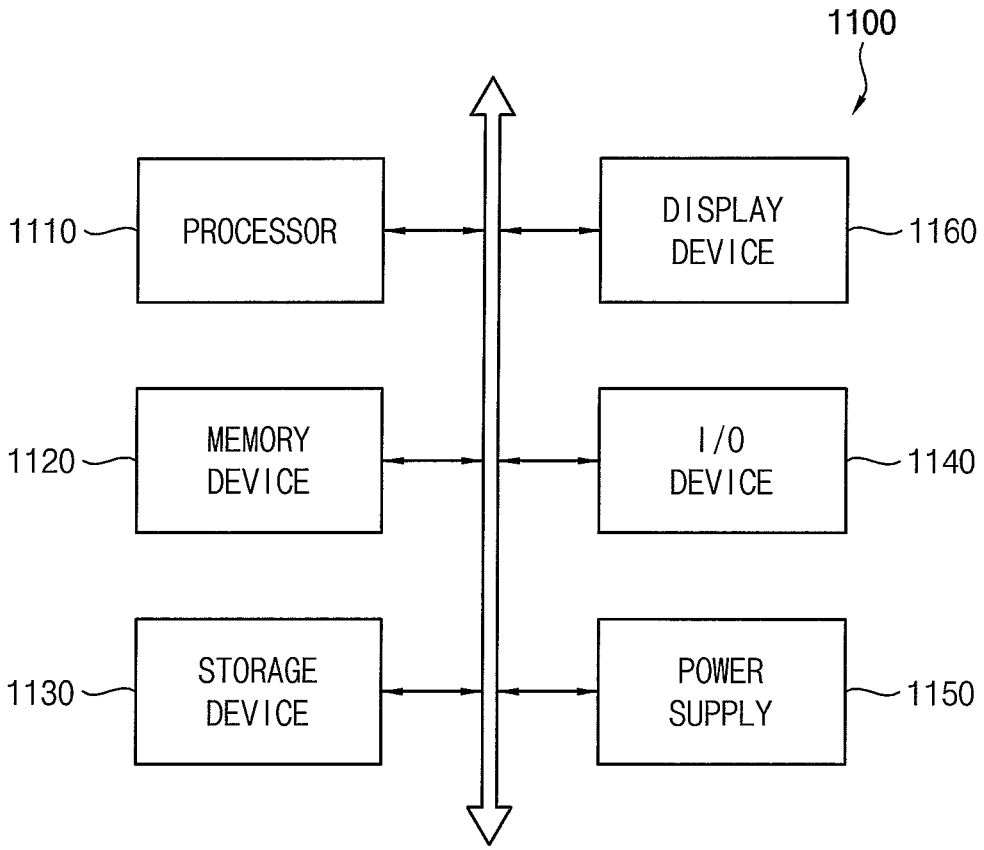
FIG. 13 is a block diagram illustrating an electronic device including a display device according to one or more example embodiments.

FIG. 13 is a block diagram illustrating an electronic device including a display device according to one or more example embodiments.

Referring to FIG. 13, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating with a video card, a sound card, a memory card, a universal serial bus (USB) device, other electric devices, and/or the like.

The processor 1110 may perform various computing functions or tasks. The processor 1110 may be an application processor (AP), a micro-processor, a central processing unit (CPU), and/or the like. The processor 1110 may be connected to other components via an address bus, a control bus, a data bus, and/or the like. Further, in some example embodiments, the processor 1110 may be further connected to an extended bus, for example, such as a peripheral component interconnection (PCI) bus.

The memory device 1120 may store data for operations of the electronic device 1100. For example, the memory device 1120 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, and/or the like, and/or at least one volatile memory device, such as a dynamic random access memory (DRAM) device, a static random access memory (SRAM) device, a mobile dynamic random access memory (mobile DRAM) device, and/or the like.

The storage device 1130 may be a solid state drive (SSD) device, a hard disk drive (HDD) device, a CD-ROM device, and/or the like. The I/O device 1140 may be an input device, for example, such as a keyboard, a keypad, a mouse, a touch screen, and/or the like, and an output device, for example, such as a printer, a speaker, and/or the like. The power supply 1150 may supply power for operations of the electronic device 1100. The OLED display device 1160 may be connected to other components through the buses or other communication links.

For example, the electronic device 1100 may be applied to a mobile phone, a smart phone, a tablet computer, a digital TV, a 3D TV, a personal computer (PC), a home appliance, a laptop computer, a personal digital assistant (PDA), a portable multimedia player (PMP), a digital camera, a music player, a portable game console, a navigation device, and/or the like.

One or more example embodiments of the present disclosure may be applied to a display device and an electronic device using the display device. For example, one or more example embodiments of the present disclosure may be applied to a cellular phone, a smart phone, a video phone, a smart pad, a smart watch, a tablet PC, a car navigation system, a television, a computer monitor, a laptop, and/or the like.

Although some example embodiments have been described, those skilled in the art will readily appreciate that various modifications are possible in the example embodiments without departing from the spirit and scope of the present disclosure. It will be understood that descriptions of features or aspects within each embodiment should typically be considered as available for other similar features or aspects in other embodiments, unless otherwise described. Therefore, it is to be understood that the foregoing is illustrative of various example embodiments and is not to be construed as limited to the specific example embodiments disclosed herein, and that various modifications to the disclosed example embodiments, as well as other example embodiments, are intended to be included within the spirit and scope of the present disclosure as defined in the appended claims, and their equivalents.

What is claimed is:

1. A display device, comprising:

a display panel comprising a plurality of pixels;

a power manager configured to provide a first power supply voltage to the display panel through a first power supply line, and a second power supply voltage, different from the first power supply voltage, to the display panel through a second power supply line, and to measure a first current flowing through the first power supply line and a second current flowing through the second power supply line; and a panel driver configured to provide a panel driving voltage to the display panel, and to control the panel driving voltage according to a current difference between the first current and the second current.

2. The display device of claim 1, wherein each of the pixels comprises at least one transistor, wherein the panel driving voltage comprises a gate-on voltage to turn on the transistor, and wherein the panel driver is configured to control the gate-on voltage according to the current difference.

3. The display device of claim 2, wherein the transistor is a PMOS transistor, and wherein the panel driver is configured to decrease the gate-on voltage when the current difference is greater than or equal to a reference current difference, and to maintain the gate-on voltage when the current difference is less than the reference current difference.

4. The display device of claim 2, wherein the panel driver comprises a gate-on voltage table for storing a voltage level of the gate-on voltage corresponding to the current difference, and wherein the panel driver is configured to control the gate-on voltage using the gate-on voltage table to provide the gate-on voltage having the voltage level corresponding to the current difference.

5. The display device of claim 1, wherein each of the pixels comprises at least one transistor, wherein the panel driving voltage comprises a gate-off voltage to turn off the transistor, and wherein the panel driver is configured to control the gate-off voltage according to the current difference.

6. The display device of claim 5, wherein the transistor is a PMOS transistor, and wherein the panel driver is configured to decrease the gate-off voltage when the current difference is greater than or equal to a reference current difference, and to maintain the gate-off voltage when the current difference is less than the reference current difference.

7. The display device of claim 5, wherein the panel driver comprises a gate-off voltage table for storing a voltage level of the gate-off voltage corresponding to the current difference, and wherein the panel driver is configured to control the gate-off voltage using the gate-off voltage table to provide the gate-off voltage having the voltage level corresponding to the current difference.

8. The display device of claim 1, wherein each of the pixels comprises an organic light emitting diode, wherein the panel driving voltage comprises an initialization voltage to initialize the organic light emitting diode, and wherein the panel driver is configured to control the initialization voltage according to the current difference.

9. The display device of claim 8, wherein the panel driver is configured to increase the initialization voltage when the current difference is greater than or equal to a reference current difference, and to maintain the initialization voltage when the current difference is less than the reference current difference.

10. The display device of claim 8, wherein the panel driver comprises an initialization voltage table for storing a voltage level of the initialization voltage corresponding to the current difference, and wherein the panel driver is configured to control the initialization voltage using the initialization voltage table to provide the initialization voltage having the voltage level corresponding to the current difference.

11. The display device of claim 1, wherein the power manager comprises:

a first power supply circuit configured to provide the first power supply voltage to the display panel through the first power supply line;

a second power supply circuit configured to provide the second power supply voltage to the display panel through the second power supply line;

a first current measuring circuit connected to the first power supply line, and configured to measure the first current;

a second current measuring circuit connected to the second power supply line, and configured to measure the second current;

a leakage current calculator configured to calculate the current difference between the first current and the second current; and a compensation signal generator configured to generate a leakage current compensation signal according to the current difference, wherein the panel driver is configured to control the panel driving voltage in response to the leakage current compensation signal.

12. The display device of claim 1, wherein the display panel comprises a display substrate, wherein the power manager is on a power management substrate at a first side of the display substrate, and wherein the panel driver is on a panel driving substrate at a second side of the display substrate.

13. A display device, comprising:

a display panel comprising a plurality of pixels;

a power manager configured to provide a first power supply voltage to the display panel through a first power supply line, and a second power supply voltage, different from the first power supply voltage, to the display panel through a second power supply line, and to measure a first current flowing through the first power supply line and a second current flowing through the second power supply line; and a panel driver configured to provide a gate-on voltage, a gate-off voltage, and an initialization voltage, and to control the gate-on voltage, the gate-off voltage, and the initialization voltage according to a current difference between the first current and the second current.

14. The display device of claim 13, wherein the panel driver is configured to decrease the gate-on voltage, decrease the gate-off voltage, and increase the initialization voltage when the current difference is greater than or equal to a reference current difference, and wherein the panel driver is configured to maintain the gate-on voltage, the gate-off voltage, and the initialization voltage when the current difference is less than the reference current difference.

15. The display device of claim 13, wherein the panel driver comprises a gate-on voltage table, a gate-off voltage table, and an initialization voltage table, wherein the gate-on voltage table is configured to store a first voltage level of the gate-on voltage corresponding to the current difference, wherein the gate-off voltage table is configured to store a second voltage level of the gate-off voltage corresponding to the current difference, wherein the initialization voltage table is configured to store a third voltage level of the initialization voltage corresponding to the current difference, and wherein the panel driver is configured to control the gate-on voltage using the gate-on voltage table to provide the gate-on voltage having the first voltage level corresponding to the current difference, to control the gate-off voltage using the gate-off voltage table to provide the gate-off voltage having the second voltage level corresponding to the current difference, and to control the initialization voltage using the initialization voltage table to provide the initialization voltage having the third voltage level corresponding to the current difference.

16. The display device of claim 13, wherein the power manager comprises:

a first power supply circuit configured to provide the first power supply voltage to the display panel through the first power supply line;

a second power supply circuit configured to provide the second power supply voltage to the display panel through the second power supply line;

a first current measuring circuit connected to the first power supply line, and configured to measure the first current;

a second current measuring circuit connected to the second power supply line, and configured to measure the second current;

a leakage current calculator configured to calculate the current difference between the first current and the second current; and a compensation signal generator configured to generate a leakage current compensation signal according to the current difference, wherein the panel driver is configured to control the gate-on voltage, the gate-off voltage, and the initialization voltage in response to the leakage current compensation signal.

17. A method of operating a display device, comprising:

providing a first power supply voltage to a display panel through a first power supply line;

providing a second power supply voltage that, is different from the first power supply voltage, to the display panel through a second power supply line;

providing a panel driving voltage to the display panel;

measuring a first current flowing through the first power supply line and a second current flowing through the second power supply line; and controlling the panel driving voltage according to a current difference between the first current and the second current.

18. The method of claim 17, wherein the panel driving voltage comprises a gate-on voltage to turn on a transistor, and wherein controlling the panel driving voltage according to the current difference comprises:

decreasing the gate-on voltage according to the current difference when the current difference is greater than or equal to a reference current difference; and maintaining the gate-on voltage according to the current difference when the current difference is less than the reference current difference.

19. The method of claim 17, wherein the panel driving voltage comprises a gate-off voltage to turn off a transistor, and wherein controlling the panel driving voltage according to the current difference comprises:

decreasing the gate-off voltage according to the current difference when the current difference is greater than or equal to a reference current difference; and maintaining the gate-off voltage according to the current difference when the current difference is less than the reference current difference.

20. The method of claim 17, wherein the panel driving voltage comprises an initialization voltage to initialize an organic light emitting diode, and wherein controlling the panel driving voltage according to the current difference comprises:

increasing the initialization voltage according to the current difference when the current difference is greater than or equal to a reference current difference; and maintaining the initialization voltage according to the current difference when the current difference is less than the reference current difference.

* * * * *